US009856661B2

(12) United States Patent
Westermann et al.

(10) Patent No.: US 9,856,661 B2
(45) Date of Patent: Jan. 2, 2018

(54) TRUCK-MOUNTED CONCRETE PUMP AND PROTECTIVE CIRCUIT THEREFOR

(71) Applicant: Putzmeister Engineering GmbH, Aichtal (DE)

(72) Inventors: Karl Westermann, Walddorfhäslach (DE); Knut Kasten, Ostfildern (DE)

(73) Assignee: Putzmeister Engineering GmbH, Aichtal (DE)

( * ) Notice: Subject to any disclaimer, the term of this patent is extended or adjusted under 35 U.S.C. 154(b) by 0 days.

(21) Appl. No.: 15/207,447

(22) Filed: Jul. 11, 2016

(65) Prior Publication Data

US 2016/0326755 A1 Nov. 10, 2016

Related U.S. Application Data

(63) Continuation of application No. PCT/EP2015/050397, filed on Jan. 12, 2015.

(30) Foreign Application Priority Data

Jan. 13, 2014 (DE) ..... 10 2014 200 396

(51) Int. Cl.
*E04G 21/04* (2006.01)

(52) U.S. Cl.
CPC ..... *E04G 21/0463* (2013.01); *E04G 21/0436* (2013.01); *E04G 21/0445* (2013.01)

(58) Field of Classification Search
CPC ..... E04G 21/0436
See application file for complete search history.

(56) References Cited

U.S. PATENT DOCUMENTS 4,418,713 A * 12/1983 Schlecht ..... E04G 21/04 137/351
4,424,985 A * 1/1984 Holmes ..... B66C 23/80 254/423

(Continued)

FOREIGN PATENT DOCUMENTS

| | | | |
|---|---|---|---|
| CN | 202493871 | U | 10/2012 |
| DE | 10 2004 007 509 | A1 | 9/2005 |
| JP | H09-323899 | A | 12/1997 |

OTHER PUBLICATIONS

English translation of the International Preliminary Report on Patentability, PCT/EP2015/050397, dated Feb. 16, 2016.

*Primary Examiner* — Erez Gurari
(74) *Attorney, Agent, or Firm* — Bose McKinney & Evans LLP

(57) ABSTRACT

This disclosure relates to a truck-mounted concrete pump including a vehicle, a concrete distributor boom disposed on the vehicle and including multiple boom arms that can be stowed, in the form of an arm assembly, on a vehicle-mounted boom resting unit, and a boom hydraulic system configured to stow and unfold the arm assembly and including a hydraulic cylinder that moves the arm assembly against the boom resting unit in a stowing movement. To terminate the boom stowing movement, a protective circuit is coupled to the hydraulic cylinder. The protective circuit includes a switching unit actuable under the load of the arm assembly. The switching unit has a load receiving element arranged on the boom resting unit that is resiliently deformable when stowing the arm assembly, wherein the arm assembly is only supported on the boom resting unit by the load receiving element.

11 Claims, 1 Drawing Sheet

(56) References Cited

U.S. PATENT DOCUMENTS 4,828,033 A * 5/1989 Frison ..... B67D 7/002 137/615
5,535,780 A * 7/1996 Schlecht ..... E04G 21/04 137/615
5,640,850 A * 6/1997 Benckert ..... E04G 21/04 137/884
5,640,996 A * 6/1997 Schlecht ..... B66C 13/40 137/615
6,230,741 B1 * 5/2001 Woodling ..... B66C 23/42 137/615
6,308,985 B1 * 10/2001 Wolfram ..... B60S 9/12 212/302
6,390,504 B1 * 5/2002 Fetzer ..... B60S 9/02 280/763.1
6,779,688 B1 * 8/2004 Mayer ..... E04G 21/04 137/312
6,834,911 B2 * 12/2004 Schillinger ..... B60R 3/00 296/184.1
6,983,763 B2 * 1/2006 Benckert ..... E04G 21/04 137/615
7,204,269 B2 * 4/2007 Alwes ..... B66C 23/42 137/615
7,478,834 B2 * 1/2009 Schlecht ..... B66C 23/42 280/763.1
7,654,286 B2 * 2/2010 Fuegel ..... E04G 21/04 137/615
7,654,800 B2 * 2/2010 Leibbrand ..... B60P 3/16 280/763.1
7,909,059 B2 * 3/2011 Wehner ..... B66C 23/78 137/615
8,282,130 B2 * 10/2012 Fuegel ..... B62D 53/04 280/763.1
8,366,148 B2 * 2/2013 Benz ..... B62D 21/186 212/302
8,657,335 B2 * 2/2014 Borghi ..... B66C 23/80 280/764.1
9,062,465 B2 * 6/2015 Neubert ..... E04G 21/0418
9,376,827 B2 * 6/2016 Hasel ..... E04G 21/0445
9,377,032 B2 * 6/2016 Fuegel ..... E04G 21/04
9,476,211 B2 * 10/2016 Westermann ..... E04G 21/0436
9,546,649 B2 * 1/2017 Braun ..... E04G 21/04
2007/0277881 A1 12/2007 Fugel
2014/0325976 A1 * 11/2014 Schabelreiter ..... B66C 23/54 60/477
2015/0008702 A1 * 1/2015 Wu ..... B66C 23/54 296/187.01
2015/0056084 A1 * 2/2015 Fuegel ..... E04G 21/0445 417/234
2015/0136266 A1 * 5/2015 David ..... E04G 21/0427 138/106
2015/0204089 A1 * 7/2015 Ruppel ..... E04G 21/0436 248/558
2016/0025128 A1 * 1/2016 Fugel ..... E04G 21/0436 280/763.1
2016/0032602 A1 * 2/2016 Fugel ..... B66C 23/80 248/49
2016/0185359 A1 * 6/2016 Mayer ..... B60W 50/14 701/2
2016/0326755 A1 * 11/2016 Westermann ..... E04G 21/0436
2017/0051520 A1 * 2/2017 Fugel ..... E04G 21/0436

* cited by examiner

TRUCK-MOUNTED CONCRETE PUMP AND PROTECTIVE CIRCUIT THEREFOR

RELATED APPLICATIONS

This application is a continuation of PCT/EP2015/050397, filed Jan. 12, 2015, which claims priority to DE 10 2014 200 396.2, filed Jan. 13, 2014, both of which are hereby incorporated herein by reference in their entireties.

BACKGROUND

The invention relates to a truck-mounted concrete pump having a vehicle and a concrete spreading boom that is arranged on said vehicle, said concrete spreading boom comprising multiple boom arms that can be stowed as an arm assembly on a boom resting unit that is fixed to the vehicle, and a boom hydraulics system that is embodied so as to stow and to unfold the arm assembly, said boom hydraulics system comprising a first hydraulic cylinder that moves the arm assembly in a stowing movement against the boom resting unit.

In the case of such mobile concrete pumps, the distributor boom that guides the concrete supply line is folded for transporting and is stowed on a section that is spaced apart from the rotating joint for the first boom arm on the boom resting unit or a boom pedestal so that transverse movements in the driving state or boom movements when driving on for example uneven roads are avoided as much as possible. It is possible when using the hydraulic system to press the arm assembly so intensely downwards that even in the case of travelling on roads an improved fixing arrangement is achieved by means of bracing the arm assembly against the substructure; however, in the event of operator error an undesired plastic deformation of the substructure or damage to the chassis occurs.

SUMMARY

This disclosure improves the truck-mounted concrete pump that is known from the prior art and provides a simple means for protecting against self-inflicted damage.

This disclosure is based on the principle of integrating a force-sensing element in the load path for the arm assembly in the driving state. Accordingly, in accordance with this disclosure, a protective circuit is proposed, said circuit being coupled to the hydraulic cylinder that drives the boom and preferably automatically terminating the stowing movement, said circuit also comprising a switching or sensor unit that can be actuated under the load of the arm assembly, in other words that receives the load of the arm assembly and triggers when reaching a threshold load. The (vertical) load of the boom (its own weight) is in other words transferred to the vehicle by way of the boom resting unit, wherein the sensor unit is attached between the arm assembly and boom resting unit in such a manner that said sensor unit supports the entire load of the arm assembly without a bypass. In this manner, it is possible to limit the resting force to within a permissible range without it being necessary to recalculate the measurement values. A retrofitting of existing machine variants is also thereby possible in a problem-free manner. A strengthening of the substructure as a countermeasure against damage is no longer necessary by virtue of the fact that the load when driving is not additionally increased.

Advantageously, the switching unit comprises a load receiving element that is arranged on the boom resting unit and can be deformed in a resilient manner when stowing the arm assembly. In this manner, it is possible for the load to be ascertained by means of a simple measurement of the deformation, wherein the deformation together with a mechanical trigger is rendered possible in the case of achieving a predetermined deformation state.

In this context, it is also advantageous if the load receiving element forms a part of the load path for distributing the weight of the arm assembly onto the vehicle.

A further advantageous embodiment provides that the arm assembly is only supported on the boom resting unit by way of the load receiving element so that the load path is clearly defined.

In order to be able to support the loads that occur, it is advantageous if the load receiving element is designed to receive in a resilient manner a force of at least 1 kN, preferably more than 10 kN.

A constructively advantageous, compact embodiment that can be achieved provides that the load receiving element comprises a resilient element assembly, in particular a disk spring assembly, that can be compressed by means of the arm assembly.

For an automatic protective effect, it is advantageous if the switching unit comprises a limit switch that triggers at the end of the stowing movement, wherein the limit switch automatically terminates the stowing movement. It is possible by means of such a switching procedure to automatically override the hydraulics system in a simple manner.

It is also advantageous if the protective circuit comprises a hydraulic adjusting member, in particular a directional control valve, that is connected to the hydraulic cylinder.

A rapid reaction shut down is rendered possible by virtue of the fact that the limit switch disconnects a controller connection of the directional control valve from an operating device.

In an advantageous embodiment, the hydraulic cylinder is connected in an articulated manner in particular on the rod side to a first boom arm of the arm assembly, wherein the protective circuit interrupts the in particular rod-side pressure oil supply of the hydraulic cylinder so as to terminate the stowing movement.

A further improvement in the ease of use provides that as the protective circuit is tripped, a signal is output for a user of the concrete distributor boom.

The subject of this disclosure is also a protective circuit as an integrated system for a truck-mounted concrete pump for limiting the boom stowing force.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

Figure 1:
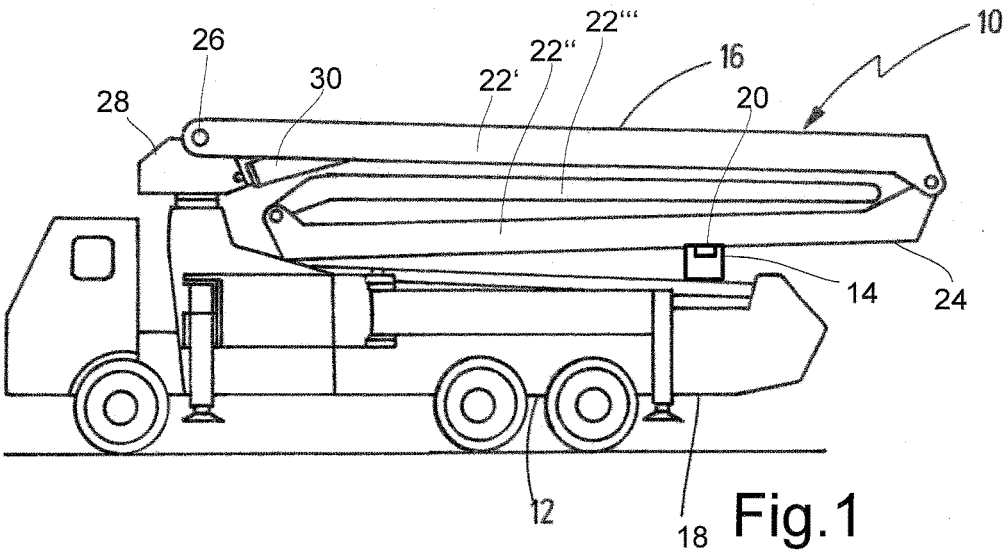
FIG. 1 illustrates a side view of a truck-mounted concrete pump in the transport position of the concrete distributor boom that is stowed on a boom pedestal.

The embodiments described below are not intended to be exhaustive or to limit the invention to the precise forms disclosed in the following description. Rather, the embodiments are chosen and described so that others skilled in the art may appreciate and understand the principles and practices of this disclosure.

It should be generally understood that terms connoting orientation such as "horizontal" and "vertical" are used herein to generally establish positions of individual components relative to one another rather than an absolute angular position in space. Further, regardless of the reference frame, in this disclosure terms such as "vertical," "parallel," "horizontal," "right angle," "rectangular" and the like are not used to connote exact mathematical orientations or geometries, unless explicitly stated, but are instead used as terms of approximation. With this understanding, the term "vertical," for example, certainly includes a structure that is positioned exactly 90 degrees from horizontal, but should generally be understood as meaning positioned up and down rather than side to side. Other terms used herein to connote orientation, position or shape should be similarly interpreted. Further, it should be understood that various structural terms used throughout this disclosure and claims should not receive a singular interpretation unless it is made explicit herein. By way of non-limiting example, the terms "hydraulic cylinder," "boom arm," and "joint," to name just a few, should be interpreted when appearing in this disclosure and claims to mean "one or more" or "at least one." All other terms used herein should be similarly interpreted unless it is made explicit that a singular interpretation is intended.

The truck-mounted concrete pump 10 comprises a transporting vehicle 12, a concrete distributor boom 16 that can be supported on said vehicle by way of a boom resting unit or a boom pedestal 14, and a pump unit 18 for conveying fluid concrete to a concreting site that is remote from the vehicle by way of the folded concrete distributing boom 16, wherein its folding or stowing movement is automatically terminated in the illustrated transporting position on the boom pedestal 14 by means of a protective circuit 20 when achieving a stowing force threshold.

The concrete distributor boom 16 comprises multiple boom arms 22 (22', 22", 26'") that can be pivoted relative to one another and are connected as a folding arm assembly 24 in an articulated manner to a rotating head 28 by way of a rotating joint 26 on the vehicle side end of the first boom arm. The rotating head 28 is mounted on the vehicle 12 in such a manner as to be able to rotate about a vertical axis of rotation, whereas the rotating joint 26 comprises a horizontal axis of rotation. In order to pivot the arm assembly 24 about the rotating joint 26, a first hydraulic cylinder 30 is provided, said hydraulic cylinder being connected in an articulated manner with its ends to articulation sites of the rotating head 28 and the first boom arm 22'. Further hydraulic cylinders that are not illustrated are arranged in a manner known per se on the concrete distributor boom 16 so as to unfold the further boom arms.

In the transporting or driving position that is illustrated in FIG. 1, the first boom arm 22' is aligned in a horizontal manner or only slightly inclined. However, in order to render possible specific concreting tasks in the unfolded state, a further inclination can be required so that the cylinder stroke cannot be limited to the transporting position. As a result of this, the problem occurs that the arm assembly 24 can be pressed downward by way of the hydraulic cylinder 30 so intensely when being stowed on the boom pedestal 14 that the chassis or the construction frame on which the boom pedestal 14 is supported is damaged. In order to prevent this, the vertical force of the arm assembly 24 on the boom pedestal 14 is limited in a defined manner by means of the protective circuit 20.

Figure 2:
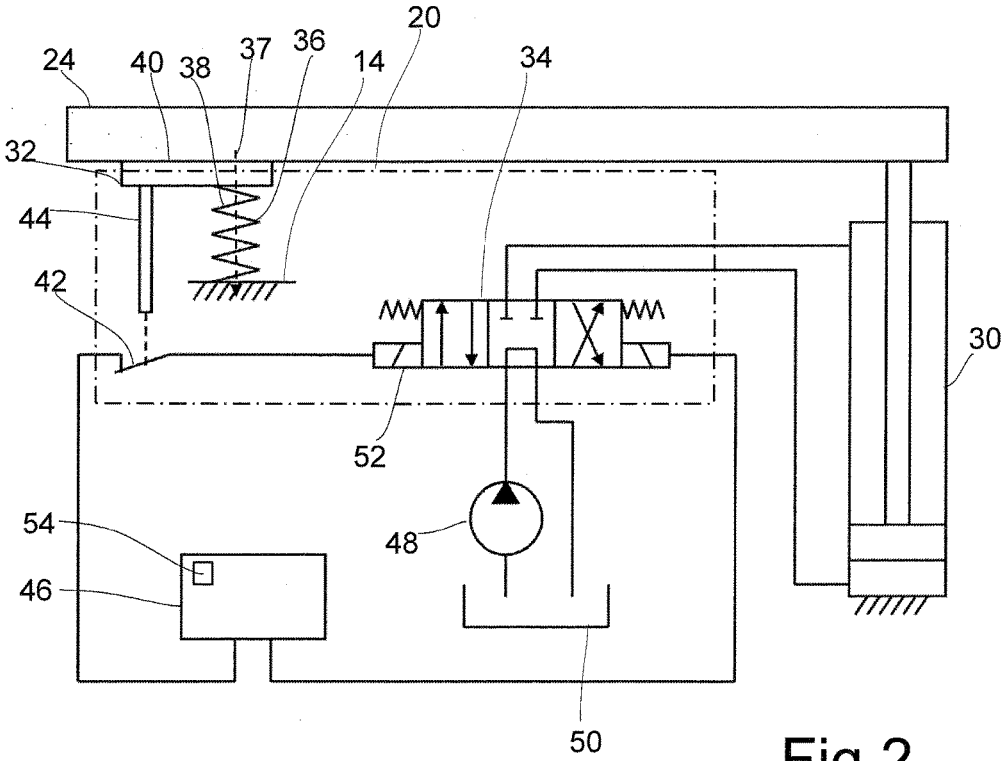
FIG. 2 illustrates a block circuit diagram of a protective circuit for limiting the boom stowing force on the boom pedestal.

As is illustrated in FIG. 2 with a simplified illustration of the hydraulic circuit, the protective circuit 20 comprises a switching unit 32 that senses the load on the boom pedestal 14 and a hydraulic adjusting member in the form of a directional control valve 34 that is coupled to the first hydraulic cylinder 30. The switching unit 32 comprises a load receiving element 36 that can resiliently deform when stowing the arm assembly 24. This forms a part of the load path 37 for distributing the weight of the arm assembly 24 onto the vehicle 12, wherein it should be ensured that the introduction of force is clear and the arm assembly 24 is only supported on the boom pedestal 14 by way of the load receiving element 36.

The load receiving element 36 forms a force sensor by way of which it is possible to ascertain deformation or resilient deformation that acts upon the boom pedestal 14. Expediently, the force threshold should not be fundamentally greater than the weight force of the arm assembly 24. For this purpose, the load receiving element 36 can be formed by means of a disk spring assembly 38 that is designed for a maximum resilient force of 10 to 20 kN. The disk spring assembly 38 can be integrated into a resilient element housing (not illustrated) on the boom pedestal 14 and by way of a prop 40 that protrudes upwards can form a supporting site for stowing the arm assembly 24.

Furthermore, the switching unit 32 comprises a limit switch 42 that triggers at the end of a predetermined deformation path or resilient path of the load receiving element 36 and stops the stowing movement. For this purpose, a switching plunger 44 is provided that can move through the arm assembly 24 in the deformation direction of the load receiving element 36, said switching plunger opening the electrical limit switch 42 as a pressure element at the end of the predetermined deformation path.

The adjusting member 34 renders it possible as a 4/3 directional control valve to control the first hydraulic cylinder 30 in two active movement directions by means of a control unit 46. When the directional control valve 34 is in the illustrated middle position centred by means of the resilient element, the pump 48 is connected through to the tank 50, and the hydraulic cylinder 30 remains pre-stressed in a self-holding manner under pressure on the base side and rod side. The hydraulic cylinder 30 is influenced in the right-hand side switching position in the extended direction in order to lift the arm assembly 24. In the left-hand side switching position, the hydraulic cylinder 30 is supplied with pressure oil so that the arm assembly 24 is stowed on the boom pedestal 14 under gravitational force and where appropriate is additionally pressed in a hydraulic manner. The force limitation is then automatically performed by virtue of the fact that the limit switch 42 disconnects the electromagnetic controller connector 52 from the control unit 46. Simultaneously, an optical or acoustic signal can be output for the user by way of a signal unit 54.

In a modified embodiment, it is also possible to use a rubber resilient load receiving element. A pressure sensor can be used in lieu of a limit switch. Alternatively, the load receiving element can also act directly upon a hydraulic valve by way of its resilient deformation path and interrupt the oil supply to the hydraulic valve. It is also feasible for a protective circuit to arrange a direct force receiver having a switching output between the arm assembly and the boom pedestal. A further possibility is a direct deformation measurement on the arm assembly or boom pedestal by means of strain gauges. Alternatively, it is also possible to determine the load of the arm assembly indirectly by way of base and rod-side pressure receivers in the hydraulic cylinder, wherein the contact with the boom pedestal is additionally queried by way of a switch.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

What is claimed is:

1. A truck-mounted concrete pump, comprising:

a vehicle;

a concrete distributor boom arranged on the vehicle and including multiple boom arms that are stowable as an arm assembly on a boom resting unit fixed to the vehicle;

a boom hydraulics system configured to stow and unfold the arm assembly and comprising a hydraulic cylinder that moves the arm assembly in a stowing movement against the boom resting unit;

a protective circuit coupled to the hydraulic cylinder and configured to terminate the stowing movement, the protective circuit comprising a switching unit actuable under the load of the arm assembly, the switching unit comprising a load receiving element arranged on the boom resting unit, the load receiving element being resiliently deformable when stowing the arm assembly, wherein the arm assembly is only supported on the boom resting unit by the load receiving element.

2. The truck-mounted concrete pump as claimed in claim 1, wherein the load receiving element is configured to resiliently receive a force of at least 1 kN.

3. The truck-mounted concrete pump as claimed in claim 1, wherein the load receiving element is configured to resiliently receive a force of at least 10 kN.

4. The truck-mounted concrete pump as claimed in claim 1, wherein the load receiving element comprises a spring assembly that is compressible by arm assembly.

5. The truck-mounted concrete pump as claimed in claim 1, wherein the spring assembly comprises a disk spring assembly.

6. The truck-mounted concrete pump as claimed in claim 1, wherein the switching unit includes a limit switch that triggers at the end of the stowing movement and automatically terminates the stowing movement.

7. The truck-mounted concrete pump as claimed in claim 1, wherein the protective circuit comprises a hydraulic adjusting member connected to the hydraulic cylinder.

8. The truck-mounted concrete pump as claimed in claim 7, wherein the hydraulic adjusting member is a directional control valve.

9. The truck-mounted concrete pump as claimed in claim 8, wherein the limit switch is configured to disconnect a controller connector of the directional control valve from a control unit.

10. The truck-mounted concrete pump as claimed in claim 1, wherein the hydraulic cylinder is connected to a first boom arm of the arm assembly and the protective circuit interrupts the oil supply of the hydraulic cylinder to thereby terminate the stowing movement.

11. The truck-mounted concrete pump as claimed in claim 1, further comprising a signal unit configured to output a signal for an operator when the switching unit is actuated.

* * * * *